United States Patent [19]

York, Jr.

[11] Patent Number: 4,869,000

[45] Date of Patent: Sep. 26, 1989

[54] ADJUSTABLE SANDAL

[76] Inventor: Harold D. York, Jr., P.O. Box 2605, Palos Verdes Peninsula, Calif. 90274

[21] Appl. No.: 125,130

[22] Filed: Nov. 25, 1987

[51] Int. Cl.[4] ..... A43B 3/24; A43B 3/12

[52] U.S. Cl. ..... 36/11.5; 36/101

[58] Field of Search ..... 36/11.5, 97, 101

[56] References Cited

U.S. PATENT DOCUMENTS

| | | | |
|---|---|---|---|
| 1,213,030 | 1/1917 | Skinner | 36/11.5 |
| 2,976,623 | 3/1961 | Gallaway | 36/11.5 |
| 3,739,501 | 6/1973 | Barrett, Jr. | 36/11.5 |
| 3,800,444 | 4/1974 | Young | 36/11.5 |
| 4,297,798 | 11/1981 | Colan | 36/11.5 |

FOREIGN PATENT DOCUMENTS

| | | | |
|---|---|---|---|
| 943532 | 7/1933 | Australia | 36/11.5 |
| 577499 | 9/1924 | France | 36/11.5 |
| 777768 | 2/1935 | France | 36/11.5 |
| 1026527 | 4/1953 | France | 36/11.5 |
| 1029166 | 6/1953 | France | 36/11.5 |
| 441651 | 1/1936 | United Kingdom | 36/11.5 |

*Primary Examiner*—Steven N. Meyers

*Attorney, Agent, or Firm*—Edward A. Sokolski

[57] ABSTRACT

A sandal has a removable ankle strap which is anchored to the sandal at its rear portion and has a pair of side straps connected to the opposite side portions thereof. The side straps cross over each other and have one of the ends thereof fixedly attached to the toe portion of the sandal while the opposite ends thereof are looped around the ankle strap. Each of the front straps is fitted through a slot formed in an anchor member. These anchor members being fixedly attached to the sandal directly below positions on the ankle strap over which the front straps are looped. Thus, the front straps can be adjusted individually to tighten or loosen their engagement with the wearer's foot by pulling such strap in one direction or the other through the anchor members.

4 Claims, 2 Drawing Sheets

ADJUSTABLE SANDAL

This invention relates to an adjustable sandal and more particularly to such a sandal having a removable ankle strap which is removably attached to a pair of adjustable cross over front straps.

Sandals have been designed which are suitable for hiking and running, such sandals generally having separate front straps and ankle straps to insure that the sandal does not inadvertently slip off the user's foot. A sandal of this general type is shown in U.S. Pat. No. 2,642,677 to Yates. Prior art sandals have been designed which have integrated front and ankle straps wherein the relative lengths of the front and ankle strap portions can be adjusted in length relative to each other. Such sandals are described in U.S. Pat. No. 4,200,997 to Scheinhaus, et al. and German Patent No. 1,947,245 to Corser. These have the disadvantage of having the adjustable straps running between the inner and outer soles of the sandal where they are readily subject to becoming lodged and difficult of adjustment particularly after continued use. Further, such one piece construction obviates the use of an ankle strap which is separately adjustable and which can be substituted with a different size strap should the wearer so require.

The sandal of the present invention overcomes the aforementioned shortcomings of the prior art in providing a pair of straps which cross over each other, each such straps having a first portion thereof which forms a front strap and a second portion thereof which forms a side strap and an ankle strap which is removably attached to the side strap portions of the "front-side" straps. The front-side straps are each fixedly attached at one end to the toe portion of the sandal. Each of such straps is fitted through the slot of an associated anchor member attached to the rear side portions of the sandal directly below the ankle strap, with the side portions of each such strap being looped around the ankle strap. Thus, each of the front-side straps can be easily adjusted to lengthen or shorten the front portion relative to the side portion thereof so that it properly holds the front portions of the user's foot without exercising undue pressure thereon, this adjustment readily being achieved by separately pulling such straps through the slots in their associated anchor members. The ankle strap is removable so that larger or smaller such straps can be installed as may be required by the particular user.

It is therefore an object of this invention to provide an improved sport sandal suitable for use in hiking and running.

It is a further object of this invention to provide an improved sport sandle in which the front and side straps are formed by a single strap member with the relative lengths of the side and front strap portions being adjustable.

Other objects of the invention will become apparent as the description proceeds in connection with the accompanying drawings of which:

Figure 1:
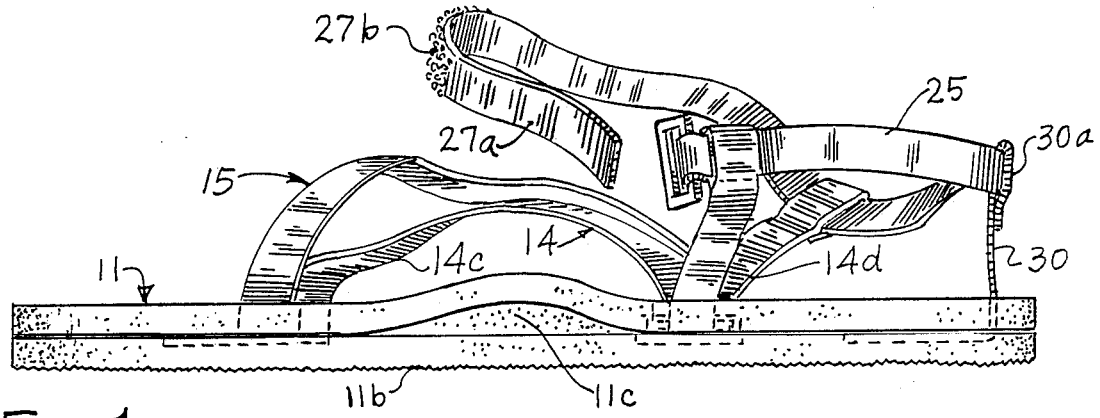
FIG. 1 is a side elevational view of a preferred embodiment of the invention.
Figure 2:
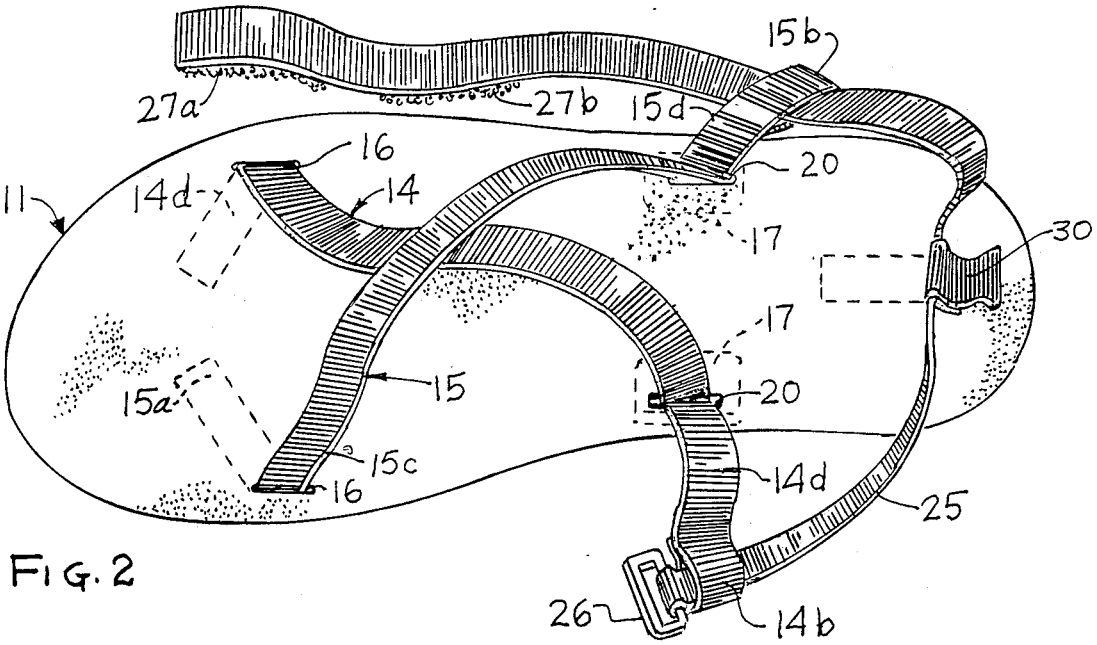
FIG. 2 is a top plan view of the preferred embodiment.
Figure 3:
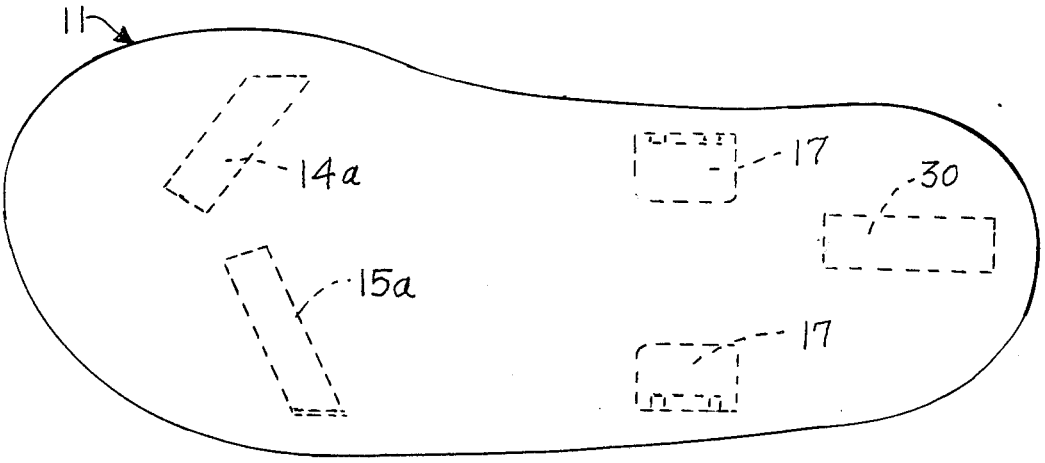
FIG. 3 is a bottom plan view of the preferred embodiment.
Figure 4:
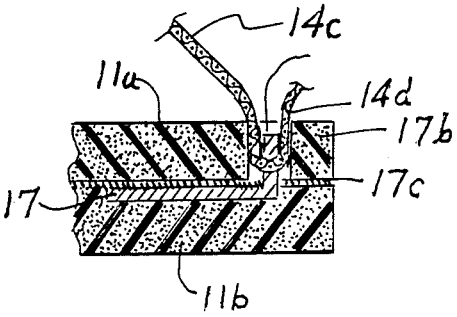
FIG. 4 is a cross sectional view illustrating the installation of the anchor member of the preferred embodiment.

Referring now to the drawings, a preferred embodiment of the invention is illustrated. The sandal has a relatively conventional sole portion 11. This sole portion includes an upper portion 11*a* and a lower portion 11*b* which are cemented together after the straps and anchor members have been cemented to the under surface of upper portion 11*a*. An arch support 11*c* is provided between the upper and lower sole portions.

A pair of straps 14 and 15 which may be fabricated of a flexible cloth material are crossed over each other and are used to form both front straps and side straps. One of the end portions 14*a*, 15*a* of each strap is fitted through an associated one of slots 16 formed in upper sole portion 11*a*, these end strap portions being cemented to the under surface of upper sole portion 11*a*.

Figure 5:
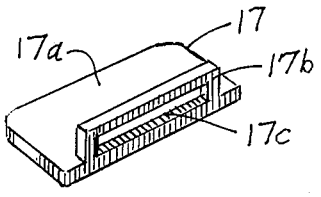
FIG. 5 is a perspective view of the anchor member of the preferred embodiment.

A pair of anchor members 17 which as best can be seen in FIG 5 have broad flat base portions 17*a* with a upstanding wall portion 17*b* which extends substantially normally therefrom. An elongated rectangular slot 17*c* suitable for receiving straps 14 and 15 is formed in upstanding portion 17*b*. The base portions 17*a* of the anchor members are cemented to the undersurface of upper sole portion 11*a* on opposite sides of the heel region thereof with the upstanding slotted portion 17*b* thereof fitted in slots 20 formed through upper sole portion 11*a*. Anchor members are preferably made of a highly durable material such as nylon.

Straps 14 and 15 are each run through an associated one of the slots 17*c* of the anchor members. The end portions 14*b* and 15*b* of straps 14 and 15 are looped over and stitched to form loops for removably receiving ankle strap 25. Thus, each of straps 14 and 15 has a front portion 14c, 15*c* and a side portion 14*d*, 15*d*, the length of these portions being variable depending on how far the straps are pulled through slots 17*c*.

Ankle strap 25 has a buckle 26 attached to one end thereof with Velcro fastener sections 27*a* and 27*b* being provided near the opposite ends of the strap. A heel strap 30 having a loop 30*a* on the upper end thereof for removably receiving ankle strap 25 is cemented to the inner surface of the heel portion of upper sole portion 11*a*. Ankle strap 25 is slidably fitted through loops 30*a*, 14*b* and 15*b*. This strap thus can readily be removed and replaced if so desired.

Figure 6:
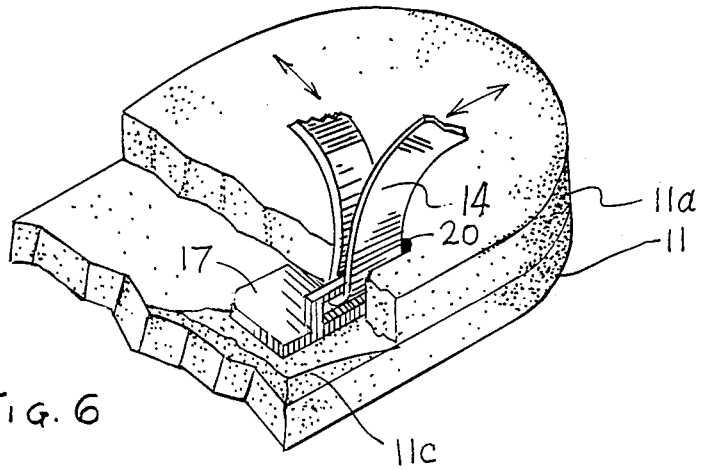
FIG. 6 is a perspective view with partial cut-away section illustrating the installation of the anchor member of the preferred embodiment.
Figure 7:
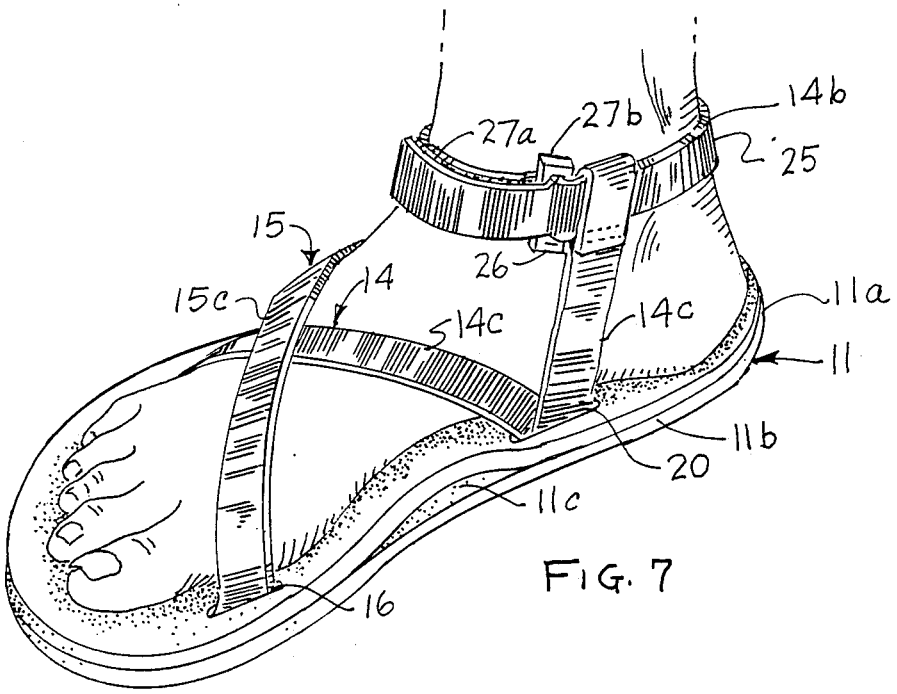
FIG. 7 is a perspective view illustrating the preferred embodiment on a user's foot.

As can be seen in FIG. 7, the sandal is placed on the user's foot with the Velcro fasteners 27*a* and 27*b* being used to hold the straps in place. The relative lengths of the front straps 14*c* and 15*c* and the side straps 14*d* and 15*d* can be adjusted by pulling the straps in either direction through slots 17*c* as shown in FIG. 6. Thus, the sandal can be adjusted to accommodate foot dimensions as well as the use of the sandal either bare footed or with socks or booties on the user's foot merely by pulling straps 14 and 15 in either direction. Further, ankle strap 25 can easily be removed and replaced with a larger or smaller strap should the situation so require.

While the invention has been described and illustrated in detail, it is to be clearly understood that this is intended by way of illustration and example only and is not to be taken by way of limitation, the spirit and scope of the invention being limited only by the terms of the following claims.

I claim:

1. A sandal comprising:

a sole portion;

first and second similar straps, one end of each of said straps being attached to said sole portion in the toe region thereof in opposing relationship, the ends of each of said straps opposite to said one ends thereof having loops formed therein;

a pair of similar anchor members, said anchor members having a base portion and a slotted portion, the base portions of said anchor members being attached to the sole portion at opposite sides of the heel region thereof in opposing relationship;

said straps being crossed over each other and each fitted through the slot in a respective one of said anchor members for slidable adjustment therein;

an ankle strap slidably fitted through the loops formed in said first and second straps; and means for removably holding said ankle strap in a looped configuration around the ankle of a user's foot;

said first and second straps each having a first portion on one side of each of said anchor members forming a front strap and a second portion on the other side of each of said anchor members forming a side strap, the relative lengths of said front and side straps being adjustable by pulling said straps through the slots in said anchor members in either direction.

2. The sandal of claim 1 and further including a heel strap attached at one end thereof to the sole portion in the heel region thereof, said strap having a loop formed therein through which the ankle strap is slidably fitted.

3. The sandal of claim 1 wherein said anchor members have a flat broad surface base portion and an upstanding slotted portion extending normally from said base portion, the sole portion having opposing slots formed therein in which the slotted portions of the anchor members are fitted.

4. The sandal of claim 1 wherein said sole portion comprises upper and lower sole portions which are joined together, said upper sole portion having first and second oppositely positioned slots formed therethrough, said one end of said first and second straps being fitted through said first and second upper sole portion slots respectively and fixedly attached to the under surface of said upper sole portion.

* * * * *